United States Patent [19]

Kim

[11] Patent Number: 4,642,048

[45] Date of Patent: Feb. 10, 1987

[54] APPARATUS FOR CONTINUOUSLY PREHEATING AND CHARGING RAW MATERIALS FOR ELECTRIC FURNACE

[76] Inventor: Youn S. Kim, 6-506 Jugong Apartment Gaza-Dong, Buk-Ku, In chon, Rep. of Korea, 160

[21] Appl. No.: 841,519

[22] PCT Filed: Jun. 24, 1985

[86] PCT No.: PCT/KR85/00014

§ 371 Date: Feb. 27, 1986

§ 102(e) Date: Feb. 27, 1986

[87] PCT Pub. No.: WO86/00394

PCT Pub. Date: Jan. 16, 1986

[30] Foreign Application Priority Data

Jun. 30, 1984 [KR] Rep. of Korea ..... 84-3820

[51] Int. Cl.[4] ..... F27B 7/00; F23K 3/00

[52] U.S. Cl. ..... 432/103; 110/101 CC; 110/226; 110/255; 432/222

[58] Field of Search ..... 110/101 R, 108, 329, 110/227, 224, 226, 255, 269, 246; 432/222, 5.73, 103

[56] References Cited

U.S. PATENT DOCUMENTS

| | | | |
|---|---|---|---|
| 3,785,304 | 1/1974 | Stookey | 110/255 |
| 4,063,903 | 12/1977 | Beningson et al. | 110/226 |
| 4,339,998 | 9/1982 | Finch | 110/101 CC |
| 4,437,418 | 3/1984 | Guillaume et al. | 110/226 |

FOREIGN PATENT DOCUMENTS

| | | |
|---|---|---|
| 57-98785 | 6/1982 | Japan . |
| 58-115294 | 4/1983 | Japan . |

*Primary Examiner*—Henry C. Yuen

*Attorney, Agent, or Firm*—Holman & Stern

[57] ABSTRACT

It is provided as shown in the drawing with a waste gas guiding duct, a rotating duct, an inserting duct, a connecting duct, a stationary duct, and a branch tube including a feed chute and a gas exhaust duct, and is adapted to preheat a main raw material consisting of direct reduced iron or small lumps of pig iron, or of auxiliary raw materials consisting of ferro-alloy and quick lime by utilizing the waste heat of a waste gas generated in a steel making furnace, weighing the total raw materials, and charging these raw materials into the electric furnace. This enables the energy to be utilized efficiently, and the quality and productivity to be improved.

1 Claim, 3 Drawing Figures

APPARATUS FOR CONTINUOUSLY PREHEATING AND CHARGING RAW MATERIALS FOR ELECTRIC FURNACE

CROSS REFERENCE TO RELATED APPLICATION(S)

This United States application stems from PCT International Application No. PCT/KR85/0014 filed June 24, 1985.

TECHNICAL FIELD

The present invention relates generaly to an apparatus for steel making furnaces and, more particularly, to the apparatus for continuously preheating and charging raw materials such as direct reduced iron (DRI) or small lumps of pig iron, if necessary, ferro-alloy or quick lime etc. By using the heat induced from the waste gas of the electric arc furnace.

BACKGROUND ART

There has been a tendency to use direct reduced iron or small lumps of pig iron for producing qualified steel products. In a conventional electric furnace, several methods have been used to charge raw materials into the furnace. One of them is to batch-charge raw materials together with steel scrap into the furnace by use of a bucket or to consequently charge them from hopper to the charging hole of the furnace roof through weigh conveyor. However, it has a disadvantage that the waste heat generated from the furnace is not utilized efficiently due to the direct exhaust into the atmosphere through the conventional bag house instead of being used to preheat raw materials, and therefore it does not contribute to efficient energy utilization and cost reduction.

Heretofore, it has been desired to improve the virginity of steel products by diluting various impurities of the steel scrap through direct reduced iron or small lumps of pig iron so as to remove undesirable effects on steel products caused by the impurities, continuously charge raw materials into furnace so as to reduce time consumption occured by batch charging with bucket and eliminate boiling phenomena which occur at the time when charging direct reduced iron together with steel scrap through a bucket, and use the same duct which permits flowing the waste gas generated from the steel making furnace as well as charging the direct reduced iron into the furnace.

SUMMARY OF THE INVENTION

It is a general object of the present invention to provide an improved apparatus for continuously prehèating and charging raw materials which avoids the disadvantages of prior techniques, while affording additional advantages.

The invention in its broad form comprises a waste gas guiding duct 1 connected to one side of swing roof 3 of electric furnace 2, a rotating duct 4 spaced apart from said guiding duct 1, an inserting duct 12 insertable into said guiding duct 1, a connecting duct 17 arranged to be lifted to a predetermined level and guided by the guide rail 19, a fixing duct 14 fixed at the lower end portion of the linear duct 4, a branch duct 24 arranged at the upper end portion of a linear duct 4 and bifurcated as a waste gas exhaust duct 23 and feed chute 22 provided with a control damper 20 and a hopper 21, a belt conveyor 26 provided with integral weighing means 27, and a bucket conveyor 25 merged into the storage 29 having a screen 28 at lower end portion thereof.

BRIEF DESCRIPTION OF THE DRAWINGS

A more detailed understanding of the invention can be had from following description of the preferred embodiment, given by way of example and to be understood in conjunction with the accompanying drawings wherein.

DETAILED DESCRIPTION OF THE INVENTION

Figure 1:
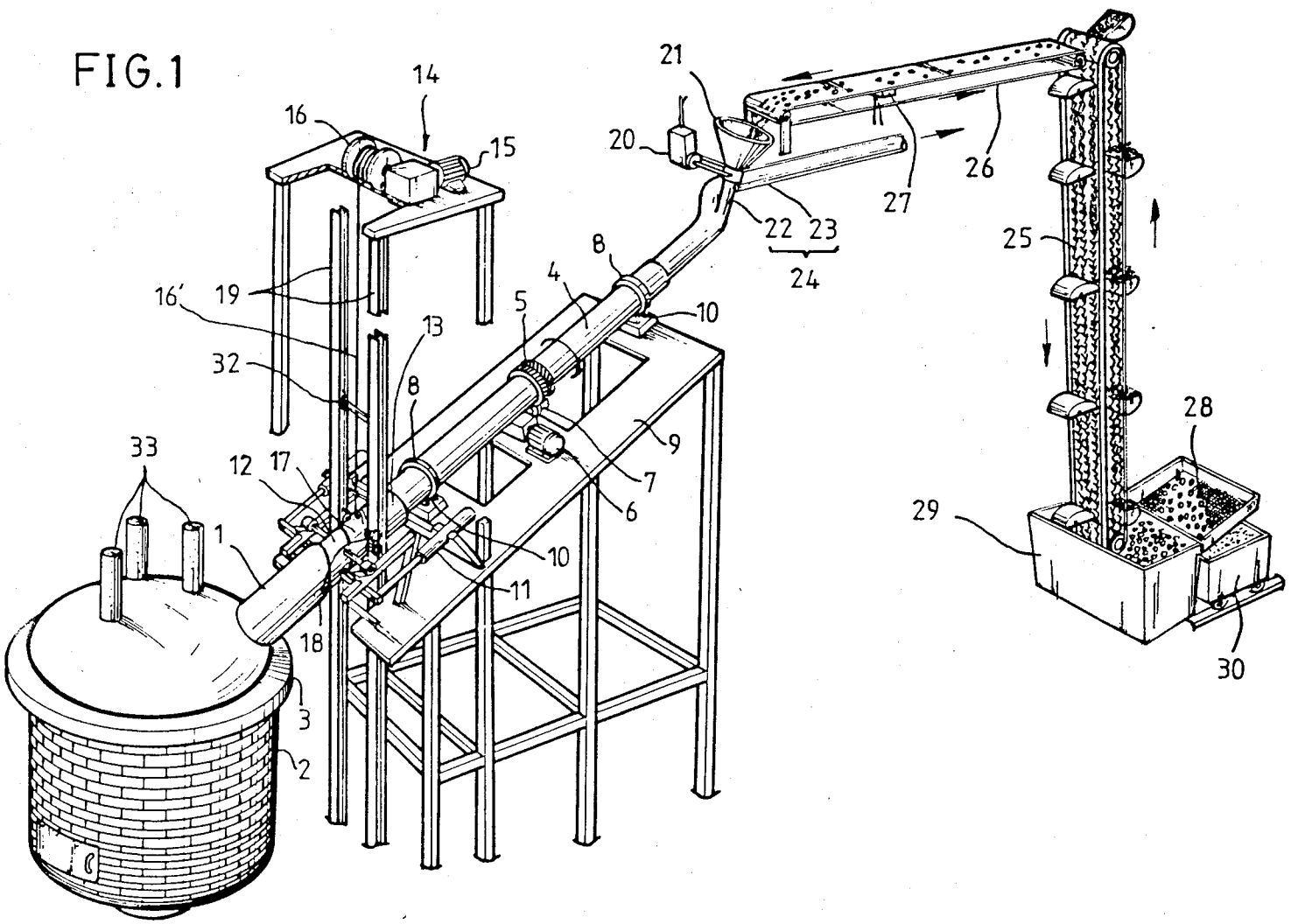
FIG. 1 is a perspective view of the apparatus for continuously preheating and charging raw materials according to the invention.

Referring now to the several drawings, especially to FIG. 1, there is illustrated the raw material preheating and charging apparatus constructed in accordance with and embodying the features of the present invention.

Refractories are provided on the inner surface of the waste gas guiding duct 1 connected to the roof 3 of electric furnace 2.

The rotating duct 4 spaced apart from the duct 1 is rotated by the gear 5 provided on central outter periphery thereof and the gear 7 operated through its motor 6.

Disposed on the upper and lower portion of the pipe 4 are two supported steel O-rings 8 which are supported and guided by the roller 10 disposed on the frame 9. The end portion of the inserting duct 12 operated by the hydraulic cylinder 11 is removably inserted into the guiding duct 1, while the lower end portion of the rotating duct 4 is fixedly inserted in the stationary duct 13. From the above description, it should be understood that the diameter of the guiding duct 1 is slightly greater than that of the inserting duct 12 and the diameter of the stationary duct 13 is also slightly greater than that of the rotating duct 4.

Figure 2:
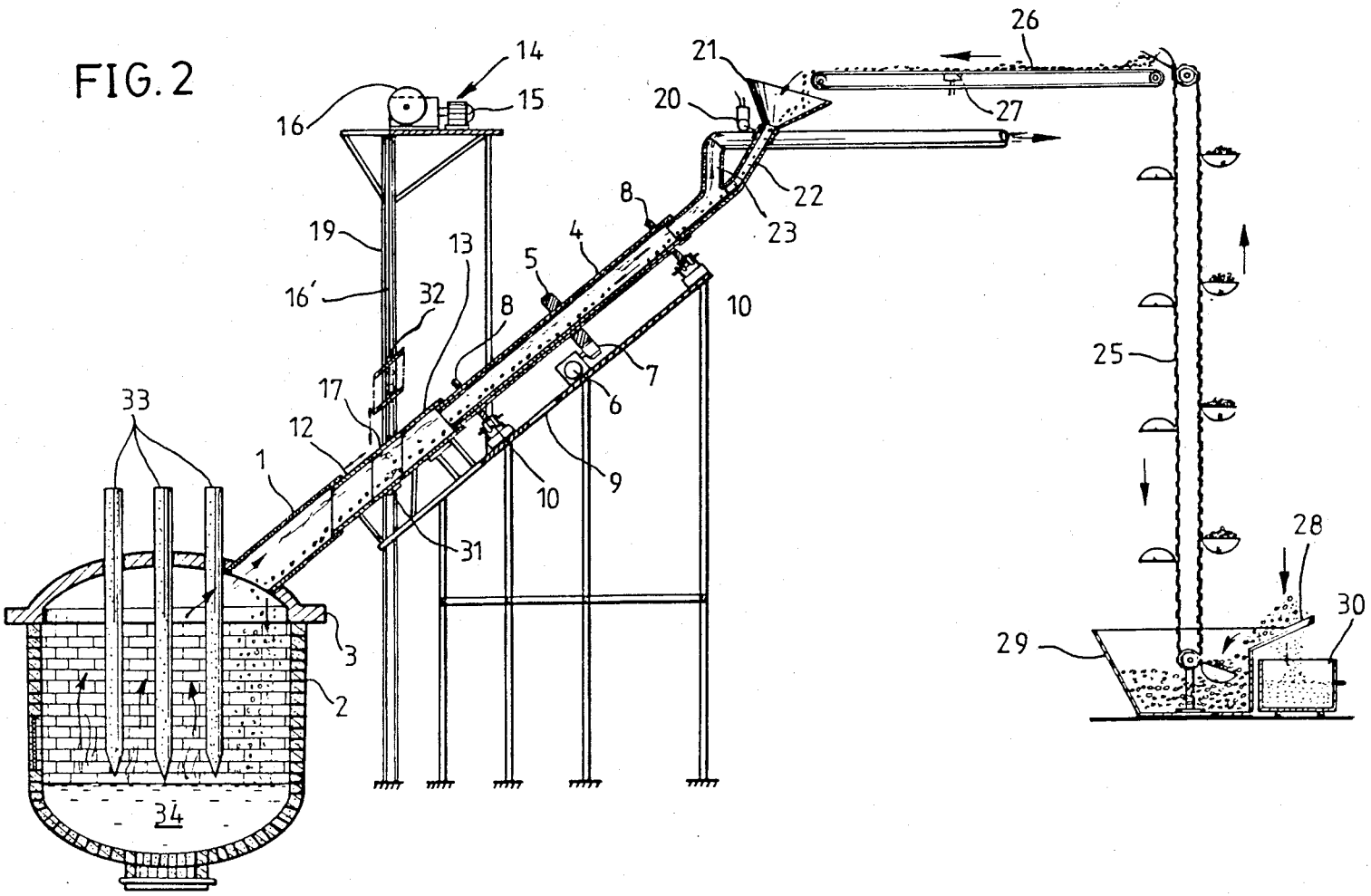
FIG. 2 is a sectional view of the apparatus shown in FIG. 1.

On the other hand, it should be noted from especially FIG. 2 that all the diameters of the three ducts (12, 13, 17) are the same size. Disposed between the duct 12 and duct 13 is connecting duct 17 which is linked to the wire 16 and lifted through two pairs of rollers 18 along the H-shape or U-shape guide rail 19. The winch 14 includes a reverse operable motor 15 and a drum 16 for lifting and lowering the connecting duct 17.

The branch tube 24 is inserted into the upper end of rotating duct 1 and includes waste gas exhaust duct 23 and feed chute 22 which is provided with hopper 21 and control damper 20 for controling the amount of charging materials. Hopper 21 cooperates with belt conveyor 26 connected to bucket conveyor 25 so as to receive the raw materials.

Weighing means 27, such as load cell, is disposed on reverse side of the belt conveyor 26 so as to measure the weight of the total raw materials passed through the belt conveyor 26, thereby generating a singal or display to control the apparatus of present invention. The raw materials stacked in the hopper 21 with predetermined height make a role as a sealing material preventing the outer air from being introduced into the hopper 21. In the previous description, the predetermined height of raw materials in the hopper 21 is permitted by the open range of the control damper 20.

The lower end portion of the bucket conveyor 25 is merged into the storage 29 provided with screen 28. The recovery bucket 30 is arranged below the screen 28 so as to receive any relatively small particles passed through the screen 28. The guide rail 19 for said connecting duct 17 includes two limit switches (31, 32) so as to sense a working position and an upper limit position, thereby controlling the operation of winch motor 15.

As briefly described in previous description, refractories are provided on all of the inner portion of guiding duct 1, rotating duct 4, inserting duct 12, stationary duct 13, and branch tube 24. Additionally a cooling water jacket (not shown), such as is conventional, may be use if desired.

The operation of said control damper 20 and conveyors (25, 26) is controlled by the measurement of weighing means 27 on the basis of presetting weight. Reference numeral 33 denotes electrodes of the furnace and 34 is the molten bed.

The operation of the apparatus according to the present invention is as follows.

Figure 3:
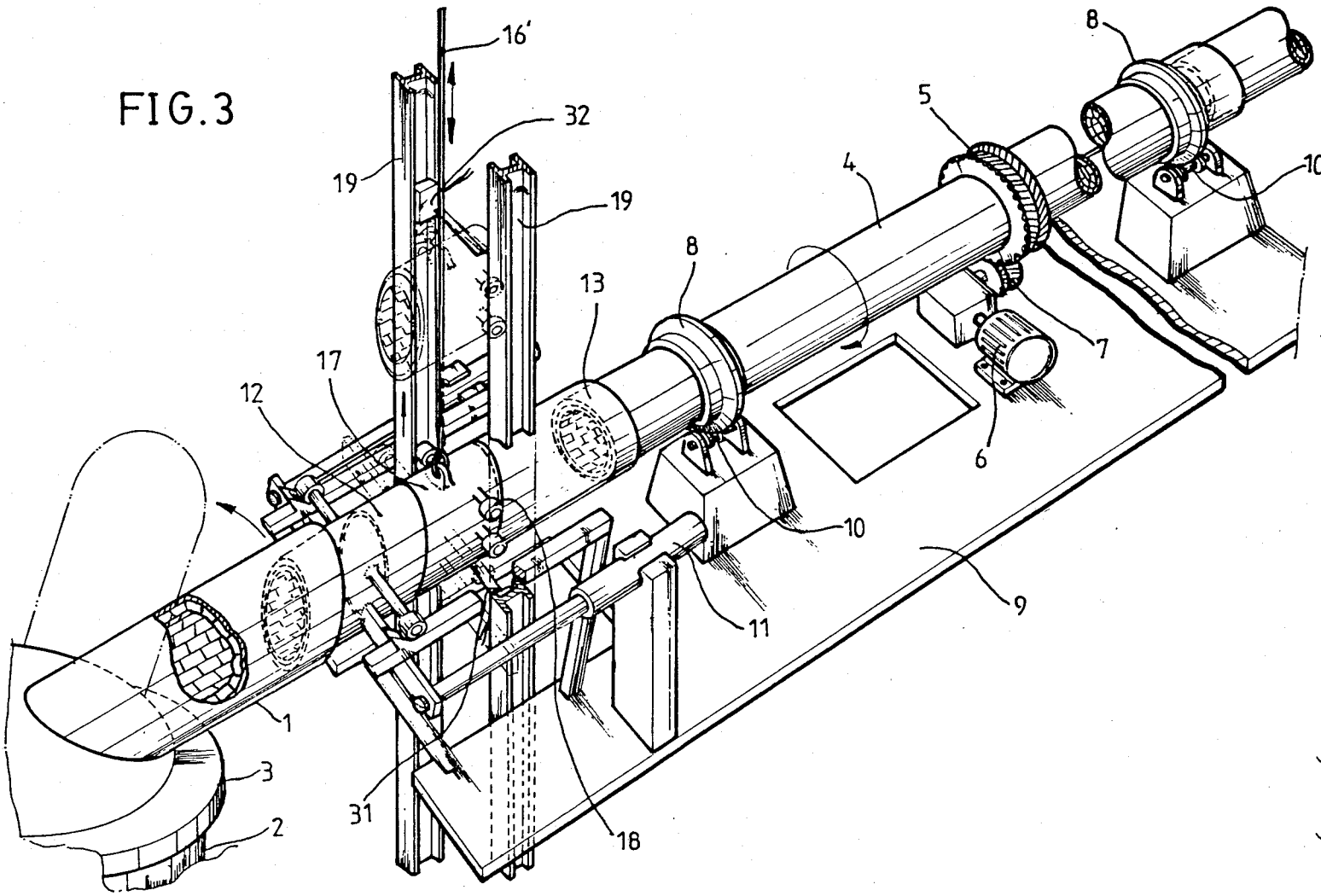
FIG. 3 is a partial enlarged perpective view of the apparatus, showing the connecting duct.

At first, before charging the raw materials, a small gap between inserting duct 12 and stationary duct 13 is created by slight insertion of inserting duct 12 into the guiding duct 1 through hydraulic cylinder 11, wherein conveyors (25, 26) and motor 6 are not operated with damper 20 closed, and then said duct 17 is lifted to the position shown as phanton line in FIG. 2 and FIG. 3 by winding the wire 16'.

If the connecting duct 17 is lifted to the upper limit position, thereby limit switch 32 is off, and motor 15 is not operated to stop the upward movement of said duct 17.

At this time, the inserting duct 12 is completely released from the guiding duct 1 by the hydraulic cylinder 11, and then swinging the roof 3 in the direction of arrow in FIG. 3 so as to initially charge a part of raw materials like steel scrap, rotating the swing roof 3 in reverse direction to close it. Inserting duct 12 is sufficiently inserted into the guiding duct 1 also through hydraulic cylinder 11 to permit the connecting duct 17 to be positioned between the inserting duct 12 and stationary duct 13.

At this time, winch motor 15 is operated to rotate the drum 16 and releasing the wire 16' and lowering the connecting duct 17.

Upon contacting said duct 17 with the limit switch 31, the motor is not operated in order to allow the connecting duct 17 to be positioned in working position. Hydraulic cylinder 11 can allow the inserting duct 12 to be returned from the guiding duct 1 in order that the connecting duct 17 can be closely positioned between the inserting duct 12 and stationary duct 13.

When completing the steps as described above, raw materials begin to be charged with operating conveyors 25, 26 and motor 6 for rotating the rotating duct 4, and with opening the control damper 20.

According to the mesh size of screen 28, it may separate particles having relative small size from the raw materials such as direct reduced iron or small lumps of pig iron.

Said small particles are dropped from screen 28 to recovery bucket 30 by gravity so as to be charged on later by batch charging, while relatively large particles are dropped into the storage 29, and they move from the latter through bucket conveyor 25 and belt conveyor 26 in which their weight is measured by weighing means 27 to the hopper 21.

On the other hand, winch motor 15 is not operated and damper 20 is open, while rotating duct 4 is rotated by the motor 6. Raw materials arrived in hopper 21 will be introduced through feed chute 22, rotating duct 4, stationary duct 13, connecting duct 17, inserting duct 12 and guiding duct 1 into the surface of the molten bed in electric furnace 2. The rotation of the duct 4 may facilitate charging operation.

While raw materials are passing through all the ducts 4, 13, 17, 12 and 1, they may be preheated by the waste gas heat so as to be achieved a rapid melting and to be prevented them from boiling occured at the end of melting period or at the beginning of refining period as the conventional charging method. This enables the energy to be utilized efficiently since the raw materials may be preheated using the waste gas heat.

Beause waste heat recovery rate is proportioned to the holding time of raw materials in ducts 4, 13, 17, 12 and 1, it can be possible to control the holding time by the radius rate between ducts 4, 13, 17, 12, and 1 and waste gas exhaust duct 23 as well as the slope of said ducts 4, 13, 17, 12 and 1.

If the weighing means 27 indicate that a predetermined amount of raw material is charged, the movement of conveyors 25, 26 and rotating duct 4 will be stop with damper 20 closed. However, the operation will be continued. From the foregoing discussion, it will be apparent that the apparatus of the present invention has several advantages compared with the prior art, that is, this enables the energy to be utilized efficiently, and the quality and productivity to be improved.

It will be understood that the above description of the present invention is susceptible to various modifications, changes, and adaptations, and the same are intended to be comprehended within the meaning and range of equivalents of the appended claims.

For example, rotating duct 4 need not be rotated according to the kind of tube, or shape of materials, especially when in spherical shape in above description, also in this case it will not be necessary to arrange the stationary duct 13.

What is claimed is:

1. Apparatus for preheating and charging raw materials for an electric furnace, comprising: a waste gas guiding duct disposed on one side of a roof of an electric furnace;

a rotating duct spaced apart from said guiding duct, and inserting duct insertable into said guiding duct;

a guide rail; p1 a storage means;

a connecting duct arranged to be lifted to an upper limit position and guided by said guide rail;

a stationary duct fixed at a lower end portion of said rotating duct;

a branch tube arranged at an upper end portion of said rotating duct, said branch tube being bifurcated as a waste gas exhaust duct and a feed chute provided with a control damper and a hopper;

a belt conveyor provided with a weighing means and a bucket conveyor merged into said storage means having a screen at a lower end portion thereof.

* * * * *